US006732789B2

(12) United States Patent
Jang

(10) Patent No.: US 6,732,789 B2
(45) Date of Patent: May 11, 2004

(54) HEAT EXCHANGER FOR $CO_2$ REFRIGERANT

(75) Inventor: Kil Sang Jang, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 0 days.

(21) Appl. No.: 10/445,905

(22) Filed: May 28, 2003

(65) Prior Publication Data

US 2003/0221819 A1 Dec. 4, 2003

(51) Int. Cl.[7] ..... F28F 9/02

(52) U.S. Cl. ..... 165/110; 165/144; 165/173; 165/174

(58) Field of Search ..... 165/144, 110, 165/153, 173, 174, 176

(56) References Cited

FOREIGN PATENT DOCUMENTS

JP 2000-81294 3/2000

*Primary Examiner*—Allen Flanigan

(74) *Attorney, Agent, or Firm*—Lowe Hauptman Gilman & Berner LLP

(57) ABSTRACT

A heat exchanger for a $CO_2$ refrigerant includes at least three rows of tube groups including a plurality of tubes having an independent refrigerant path, first and second header pipes including a header where a plurality of tube insertion holes into which the tubes are inserted are formed and a tank having partition walls formed along a direction of the flow of a refrigerant, wherein a plurality of return holes are formed in the partition walls, end caps sealing both end portions of the first and second header pipes, a coupling reinforcement portion installed at least one of the first and second header pipes and reinforcing a coupling force of the header and the tank, a refrigerant inlet pipe connected to the first or second header pipe through which the refrigerant enters, and a refrigerant outlet pipe connected to the first or second header pipe through which the refrigerant is exhausted. The refrigerant entering through the refrigerant inlet pipe is made to flow in a direction adverse to a direction in which air flows.

6 Claims, 6 Drawing Sheets

HEAT EXCHANGER FOR $CO_2$ REFRIGERANT

BACKGROUND OF THE INVENTION

This application claims the priority of Korean Patent Application No. 2002-29949 filed on May 29, 2002 in the Korean Intellectual Property Office.

1. Field of the Invention

The present invention relates to a heat exchanger, and more particularly, to a heat exchanger for a $CO_2$ refrigerant in which fluid having a cooling cycle of a supercritical pressure like $CO_2$.

2. Description of the Related Art

In general, a heat exchanger performs heat exchange as fluid having a high temperature and fluid having a low temperature transfer heat from a high temperature to a low temperature through a wall surface. An HFC refrigerant has been mainly used as an operational medium of an air-conditioning system having the heat exchanger. However, since the HFC refrigerant is recognized as one of the major reasons for global warming, a use thereof is gradually restricted. Thus, studies on a $CO_2$ refrigerant as a next generation refrigerant to replace the HPC refrigerant have been actively performed. GWP (global warming point) of $CO_2$ is about 1/1300 of R134a which is a typical HFC refrigerant. In addition, $CO_2$ has the following merits as a refrigerant. That is, since the operational compression ratio is low, a compression efficiency is high. Since a heat transfer performance is excellent, a difference in temperature between the temperature at an inlet of air which is a secondary fluid and the temperature at an outlet of a refrigerant can be small by far compared with a conventional refrigerant. Thus, since heat can be generated at a low outside temperature in the winter time by utilizing the above merits, the $CO_2$ refrigerant can be applied to a heat pump performing cooling in the summer time and heating in the winter time.

Also, since the volume cooling capacity (evaporation latent heat x gas density) of $CO_2$ is 7 or 8 times high than R134a which is a conventional refrigerant, the capacity of a compressor can be greatly reduced. Since a surface tension is small, boiling heat transfer is superior. Since specific heat at constant pressure is great and viscosity is lower, a heat transfer performance is superior so that $CO_2$ has a superior thermodynamic feature as a refrigerant. Furthermore, in view of a cooling cycle, since a gas-cooling pressure is 6–8 times (about 90–130 bar) higher than that of the conventional refrigerant, pressure loss due to the pressure drop of a refrigerant inside a heat exchanger is relatively low compared to the conventional refrigerant. Accordingly, a fine channel heat exchanger tube which is known as one having a superior heat transfer performance but a great pressure drop can be used.

However, since the cooling cycle of $CO_2$ is a supercritical pressure cycle, not only evaporation pressure but also gas cooling pressure is 6–8 times (about 90–130 bar) higher than a conventional cycle. Thus, in order to use $CO_2$ as a refrigerant, it is important to secure a superior pressure-resistance feature.

In a typical heat exchanger, multiple steps of paths are added to the flow of a refrigerant to increase a heat exchange efficiency. For the $CO_2$ refrigerant, when the refrigerant is cooled, the temperature is continuously lowered in the heat exchanger without a condensation step so that heat exchange is performed between the refrigerant paths in the heat exchanger. Thus, the heat exchange efficiency is lowered. Also, the heat exchanger needs to be made compact and the manufacture and assembly thereof must be easy and convenient.

As a heat exchanger using $CO_2$ as a refrigerant, Japanese Patent Publication No. 2000-81294 discloses a multilayer heat exchanger for a high pressure. The multilayer heat exchanger includes header pipes each including a header, a tank, and partition walls integrally formed with the tank, so that a pressure-resistance feature and a mounting feature are improved and the large size of a heat exchanger is prevented.

However, the heat exchanger has a problem in that, when the header and the tank are combined by a brazing process, a combining portion between the header and the tank is not strong enough. In particular, during assembly, the header and tank receive a considerable force so that the material can be deformed. Accordingly, contact of part of a contact portion is incomplete so that a pressure-resistance feature is deteriorated.

SUMMARY OF THE INVENTION

To solve the above and/or other problems, the present invention provides a heat exchanger using a refrigerant working under a high pressure like $CO_2$ as a heat exchange medium, in which a pressure-resistance feature is improved and simultaneously an assembly feature such as a brazing feature is improved.

The present invention provides a heat exchanger in which the structure of a header pipe is simple and simultaneously a sealing feature is superior.

The present invention provides a heat exchanger in which parts are simplified so that use of a material is reduced, a product is made light, and productivity is improved.

According to an aspect of the present invention, a heat exchanger for a $CO_2$ refrigerant comprising: at least three rows of tube groups including a plurality of tubes having an independent refrigerant path; first and second header pipes including a header where a plurality of tube insertion holes into which the tubes are inserted are formed and a tank having partition walls formed along a direction of the flow of a refrigerant, wherein a plurality of return holes are formed in the partition walls; end caps sealing both end portions of the firs and second header pipes; a coupling reinforcement portion installed at least one of the first and second header pipes and reinforcing a coupling force of the header and the tank; a refrigerant inlet pipe connected to the first or second header pipe through which the refrigerant enters; and a refrigerant outlet pipe connected to the first or second header pipe through which the refrigerant is exhausted, wherein the refrigerant entering through the refrigerant inlet pipe is made to flow in a direction adverse to a direction in which air flows.

The refrigerant inlet and outlet pipes are installed at a side end portion of the first or second header pipe.

The coupling reinforcement portion is a pressing protrusion extending from an edge of each of the end caps over an outer surface of the header and the tank.

The coupling reinforcement portion is a band member provided to encompass an outer surface of the header and the tank.

the coupling reinforcement portion is a rivet coupling the header and the tank by penetrating the partition walls.

Assuming that a width of the return hole is W1 and a distance between the neighboring return holes is W2, W1 and W2 satisfy a relationship that $W1/(W1+W2) \leqq 0.5$.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
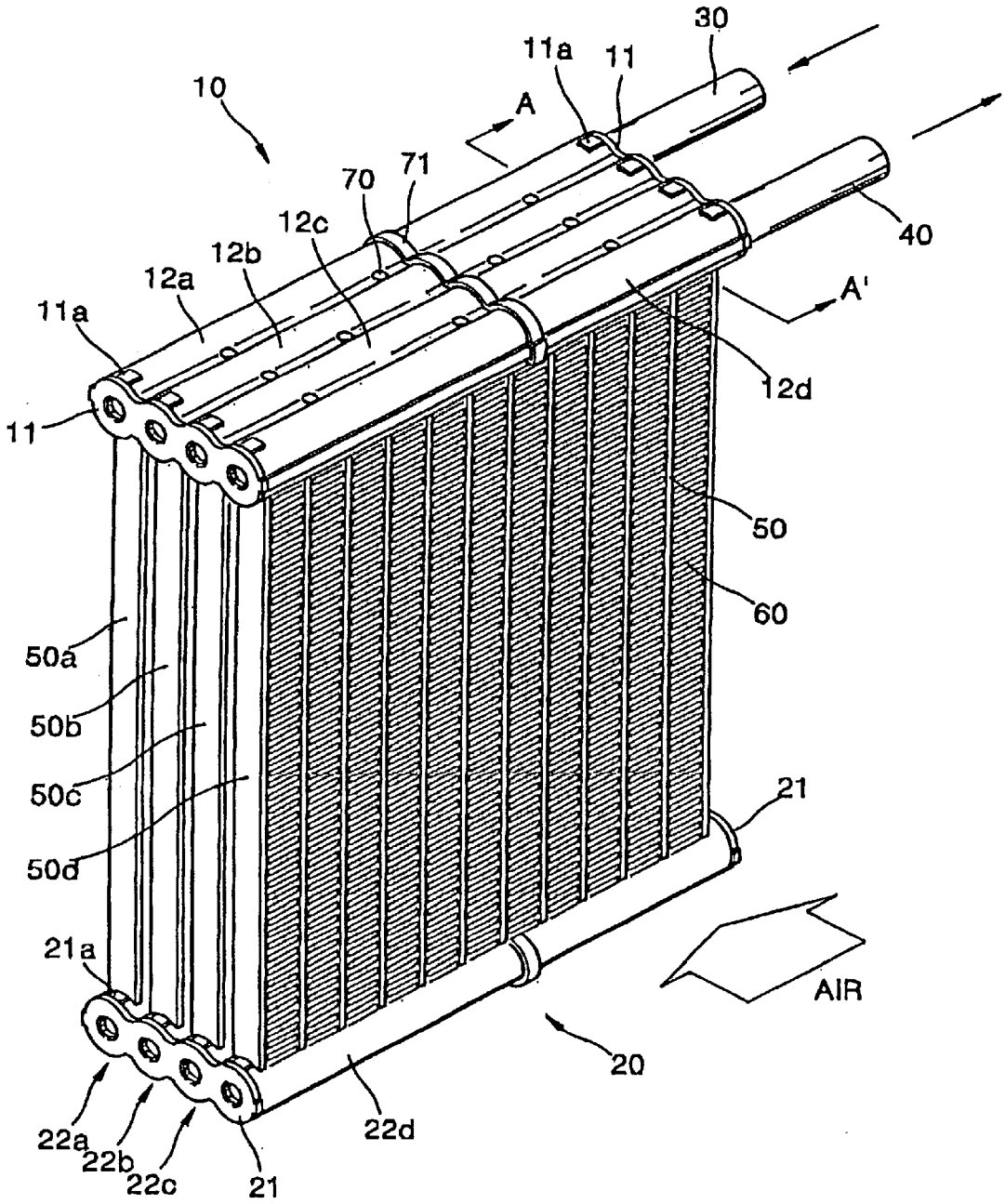
FIG. 1 is a perspective view illustrating a heat exchange according to a preferred embodiment of the present invention.

Referring to FIG. 1, a heat exchanger for $CO_2$ according to a preferred embodiment of the present invention includes a first header pipe 10 and a second header pipe 20 each having at least three partition chambers. Both end portions of the respective header pipes 10 and 20 are sealed with end caps 11 and 21. A plurality of radiation tubes 50 for flowing a refrigerant are arranged between the first and second header pipes 10 and 20. A plurality of radiation fins 60 are installed between the radiation tubes 50 so that the refrigerant flowing in the tubes 50 can smoothly perform heat exchange with air that is a secondary heat exchange medium.

In the preferred embodiment of the present invention, the respective header pipes can have four partition chambers as shown in FIG. 1-The partition chambers are connected to the partition chambers of the opposite header pipe by the radiation tubes 50 so as to form the same number of tube groups constituting a heat exchange portion as the number of the partition chambers. Thus, according to the heat exchanger for $CO_2$ according to the preferred embodiment of the present invention, four rows of the tube groups are formed.

In detail, as shown in FIG. 1, the first header pipe 10 has a first partition chamber 12*a*, a second partition chamber 12*b*, a third partition chamber 12*c*, and a fourth partition chamber 12*d* sequentially in a direction opposite to the direction in which air flows in. The second header pipe 20 has a fifth partition chamber 22*a*, a sixth partition chamber 22*b*, a seventh partition chamber 22*c*, and an eighth partition chamber 22*d* sequentially in the same direction. The first and fifth partition chambers 12*a* and 22*a*, the second and sixth partition chambers 12*b* and 22*b*, the third and seventh partition chambers 12*c* and 22*c*, and the fourth and eight partition chambers 12*d* and 22*d* are connected by the radiation tubes 50.

Figure 5:
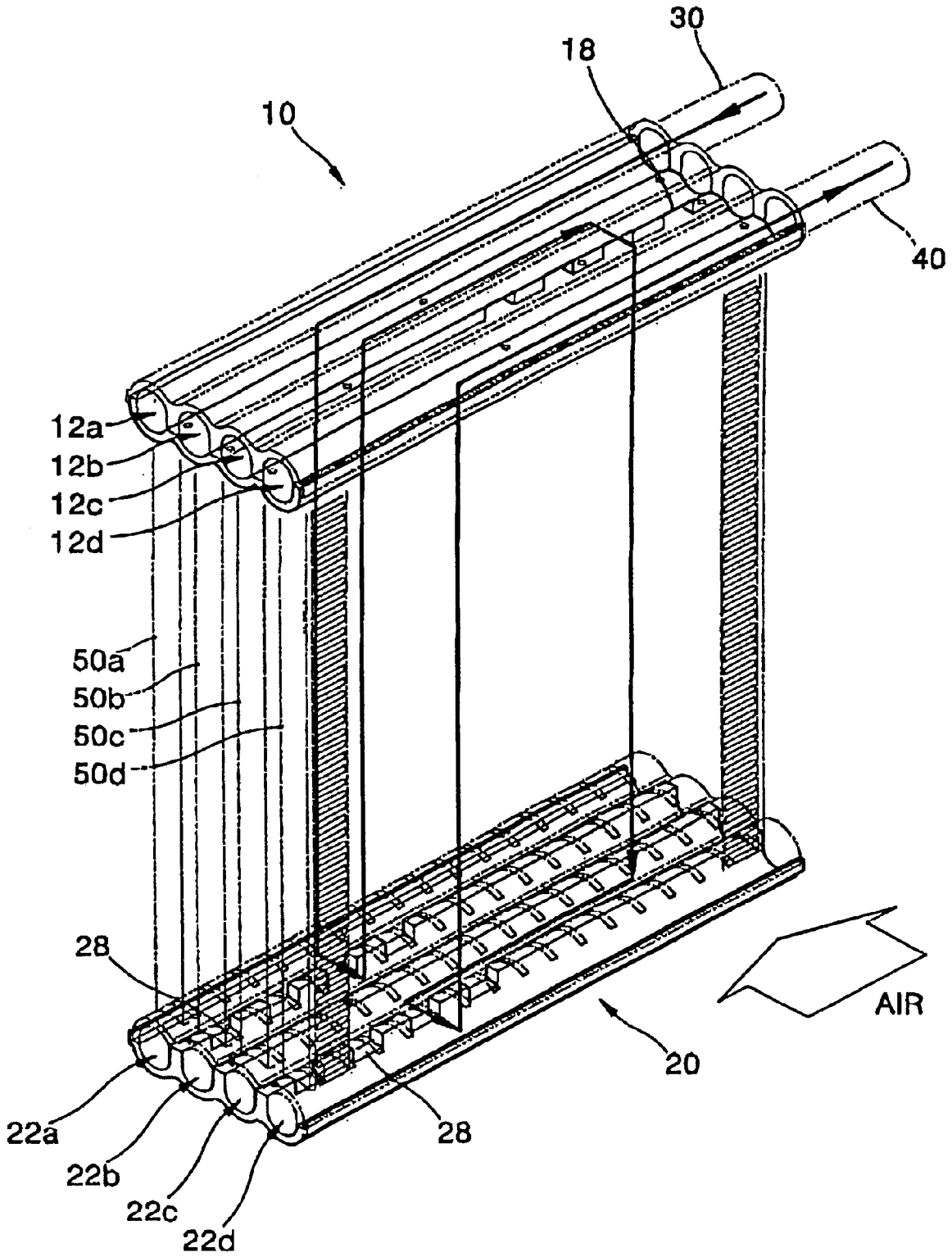
FIGS. 5 and 6 are views illustrating the flow of a refrigerant of heat exchangers according to other preferred embodiments of the present invention.

The radiation tubes 50 form four rows of tube groups arrayed in an airflow direction as shown in FIG. 5 and connecting the respective partition chambers, that is, a first tube group 50*a* connecting the first partition chamber 12*a* and the fifth partition chamber 22*a*, a second tube group 50*b* connecting the second partition chamber 12*b* and the sixth partition chamber 22*b*, a third tube group 50*c* connecting the third partition chamber 12*c* and the seventh partition chamber 22*c*, and a fourth tube group 50*d* connecting the fourth partition chamber 12*d* and the eighth partition chamber 22*d*. Each of the tube groups 50*a*, 50*b*, 50*c*, and 50*d* forms the heat exchange portion together with the partition chambers connected by each tube group. Although only the four rows of the tube groups are described in the present preferred embodiment of the present invention shown in FIG. 1, the technical concept of the present invention is not limited thereto and can be applied to a heat exchanger having at least three rows of tube groups.

The tubes constituting each of the tube groups may be individually coupled one another, as shown in FIG. 1. Although not shown in the drawings, an integral tube where the tubes of neighboring tube groups are connected by a plurality of bridges may be used. The integral tube can improve productivity by remarkably reducing the number of assembly steps. Also, each tube may be a pipe in which a singular refrigerant path is formed or a plurality of tiny flow pipes are formed.

A refrigerant inlet pipe 30 is installed at one end of the first partition chamber 12*a* of the first header pipe 10 while a refrigerant outlet pipe 40 is installed at one end of the fourth partition chamber 12*d*. Although the refrigerant inlet pipe 30 and the refrigerant outlet pipe 40 are installed at the first header pipe 10 as shown in FIG. 1, they are not limited thereto and can be applied in various ways according to the flow of a refrigerant. That is, even when the refrigerant inlet pipe 30 is installed at the first header pipe 10, since the refrigerant outlet pipe 40 is installed at the last partition chamber according to the flow of a refrigerant, in some cases, the refrigerant outlet pipe 40 can be installed at the second header pipe 20. The refrigerant inlet pipe 30 and the refrigerant outlet pipe 40 can be installed at one end portion of the first header pipe 10 and/or the second header pipe 20.

In the above heat exchanger, as shown in FIG. 1, the refrigerant outlet pipe through which the refrigerant is exhausted is preferably disposed at the side where air enters so that the air and the refrigerant form a counter flow. That is, as the refrigerant outlet pipe 40 is installed at the fourth partition chamber 12*d* where the air enters, the refrigerant flows from the refrigerant inlet pipe 30 to the refrigerant outlet pipe 40 while the air flows from the refrigerant outlet pipe 40 to the refrigerant inlet pipe 30, as shown in FIG. 1, thus exchanging heat. Accordingly, as described later, the difference in temperature between the refrigerant and the air is maintained to a constant degree and the efficiency in heat exchange is further improved.

The header pipes 10 and 20 are formed by coupling the header and tank.

Figure 2:
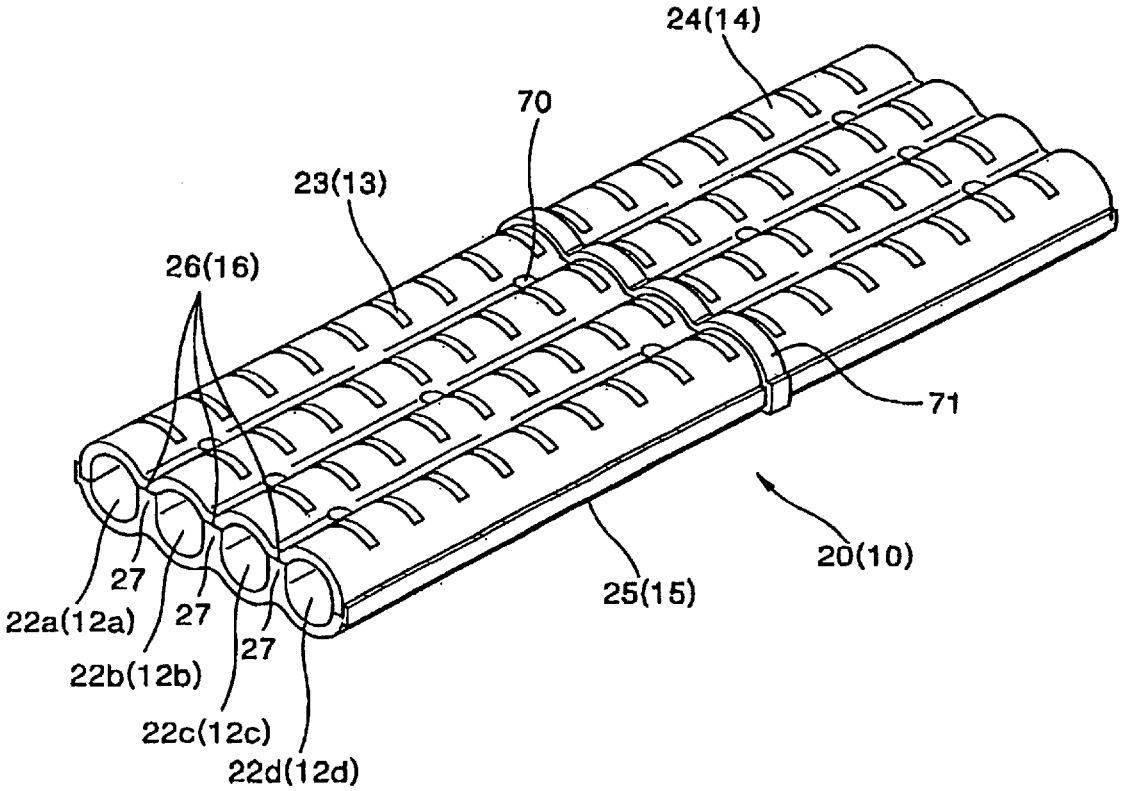
FIG. 2 is a perspective view illustrating a header pipe of the heat exchanger of FIG. 1.
Figure 3:
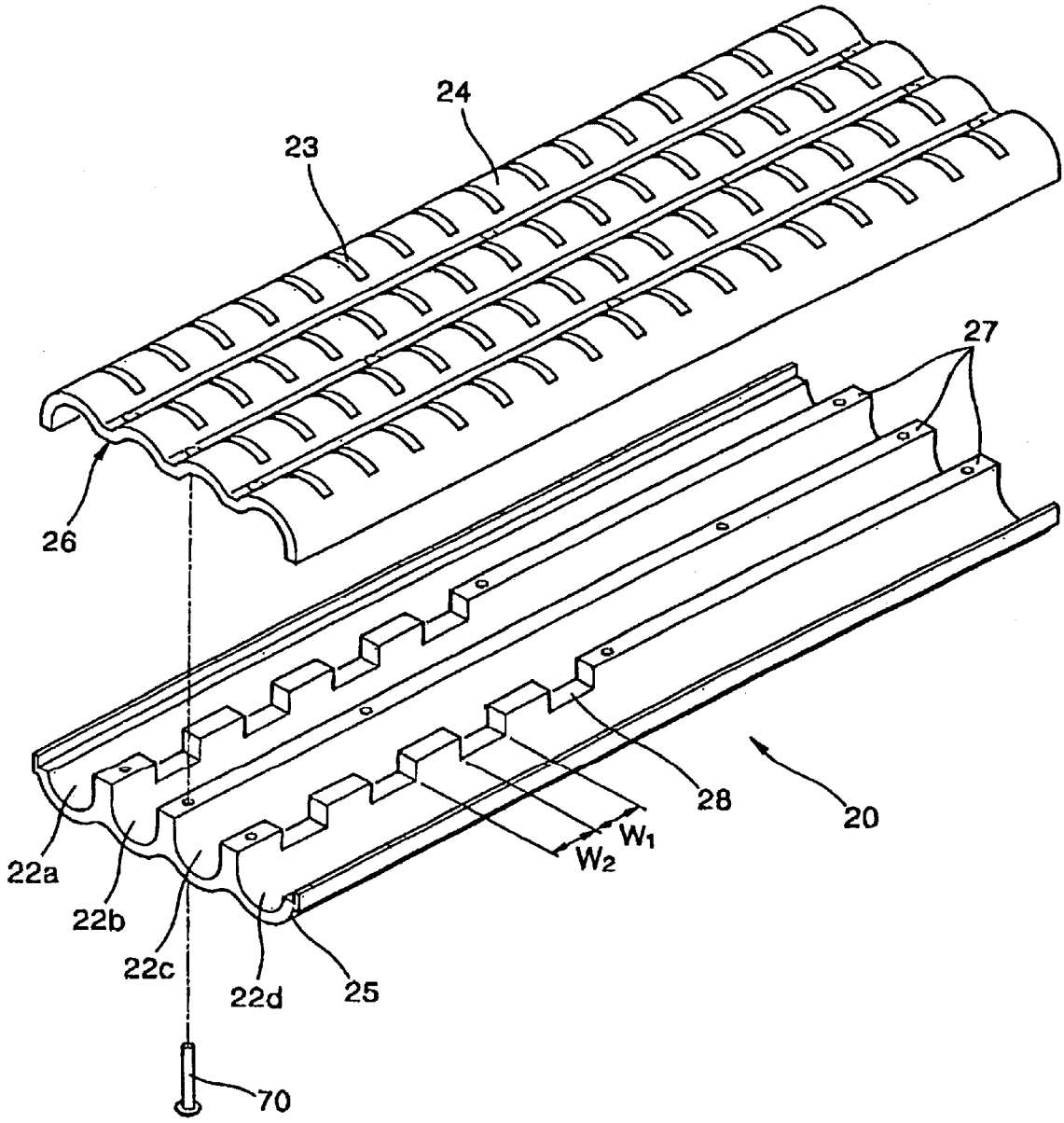
FIG. 3 is a partially exploded perspective view illustrating the second header pipe of the heat exchanger of FIG. 1.

FIGS. 2 and 3 show the structure of the header pipes 10 and 20 in detail. Although FIGS. 2 and 3 show only the second header pipe 20, since the structure can be identically applied to the first header pipe 10, the following description will focus on the second header pipe 20.

As can be seen from FIGS. 2 and 3, the second header pipe 20 according to a preferred embodiment of the present invention includes a header 24 where a plurality of tube insertion holes 23 are formed so that tubes are inserted in the holes 23 and combined thereto and a tank 25 which is combined to the header 24 and has partition walls 27 dividing the respective partition chambers 22*a*, 22*b*, 22*c*, and 22*d*. The header 24 can be formed using a brazing member and the tube insertion holes 23 where the tubes are inserted can be formed by a press process. The tank 25 is molded with an injection member and a plurality of return holes 28 for connecting the neighboring partitions according to the flow of the refrigerant are formed in the partition walls 27. As shown in FIG. 3, the return holes 28 can be arranged along the partition walls 27 at a predetermined interval with a predetermined width or a plurality of holes punched in the partition walls 27. Here, the width W1 of each of the return holes 28 is preferably not more than 50% of the sum of the width W1 of each return hole and the distance W2 between the neighboring return holes 28, that is, $W1/(W1+W2) \leqq 0.5$. This is to prevent that, when the return holes 28 are formed too great so that the distance between the neighboring partition walls is too narrow, a coupling force between the header and tank is lowered accordingly and a gap may be formed between the header and the tank at the partition portion between the return holes 28.

The header 24 and the tank 25 are combined as shown in FIG. 2 and an intermediate combination portion 26 is formed by combining end portions of the partition walls 27 of the tank 25 to the header 24. The intermediate combination portion 26 can be typically combined by a brazing process.

The present invention further includes a coupling reinforcement portion to reinforce a coupling force between the header and the tank. In a multilayer heat exchanger having a plurality of rows of the tube groups as in the present invention, flow paths of the refrigerant can be formed in various ways while the size of the a heat exchanger is reduced, thus improving the efficiency in heat exchange. However, the contact between the header and the tank at the intermediate combination portion which is a portion between the respective partition chambers when the header and the tank are coupled is instable so that brazing is not sufficiently made. To firmly couple the header and the tank, the present invention has a coupling reinforcement portion.

According to a preferred embodiment of the present invention, as shown in FIG. 1, the coupling reinforcement portion can be pressing protrusions 11*a* and 21*a* extending from the edges of the end caps 11 and 12 over the outer surfaces of the first and second header pipes 10 and 20. The pressing protrusions 11*a* and 21*a* press the header and the tank at both ends of the first and second header pipes 10 and 20 to prevent lift of the intermediate combination portion 26, as shown in FIG. 2. The pressing protrusions 11*a* and 21*a* are integrally formed with the end caps 11 and 21 and combined together when the end caps 11 and 21 are combined to the header pipes.

To prevent lift of the intermediate combination portion 26 and make the coupling of the header and the tank further firm, in another preferred embodiment of the present invention, a band member 71 encompassing the outer surface of the first and second header pipes 10 and 20 can be used as the coupling reinforcement portion, as shown in FIGS. 1 and 2. The band member 71 is a strap formed with a brazing member which is wound along the outer surface of each of the first and second header pipes 10 and 20 and combined to the outer surface by brazing. Accordingly, the band member 71 further presses the header and the tank from outside so that a lift of the intermediate combination portion is prevented and the coupling of the header and the tank can be more firm.

Another combination reinforcement portion according to another preferred embodiment of the present invention may be a rivet 70 as shown in FIGS. 1 through 4.

Figure 4:
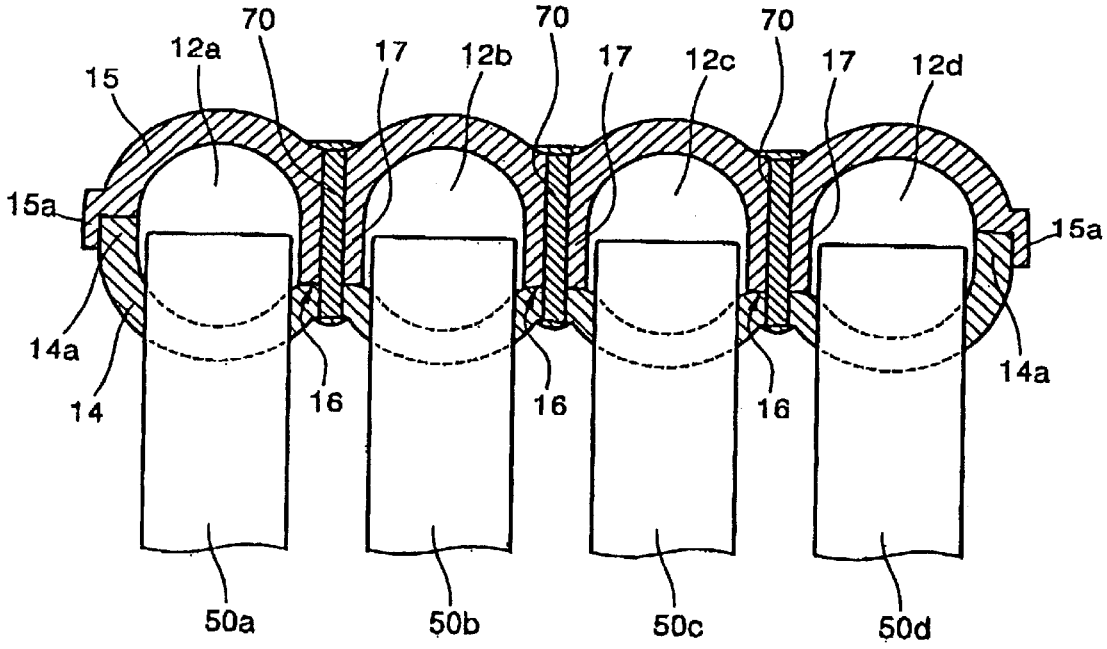
FIG. 4 is a sectional view taken along line A–A' of FIG. 1.

FIG. 4 is a sectional view taken along line A–A' of FIG. 1, illustrating the section of the first header pipe 10. This can be identically applied to the second header pipe 20.

As shown in FIG. 4, when the tank 15 having the partition walls 17 and a guide portion 15*a* provided at both end portions for the coupling of the header 14 and the header 14 having a linear portion 14*a* corresponding to the guide portion 15*a* are combined, a considerably great force must be applied for the coupling of the guide portion 15*a* of the tank 15 and the linear portion 14*a* of the header 14. However, in the case of a multilayer heat exchanger having a plurality of partition chambers arranged parallel to one another as in the present invention, as shown in FIG. 4, when a force is applied to both end portion of each pipe to couple the guide portion 15*a* of the tank 15 and the linear portion 14*a* of the header 14, a central portion of the header 14, in particular, a curved portion, is deformed so that a lift may be generated at the intermediate combination portion 16 between the partition chambers. Accordingly, when the intermediate combination portion 16 is not pressed during brazing, the brazing of the intermediate portion 16 is insufficient.

The present invention is to improve a brazing feature by preventing the generation of a gap at the intermediate combination portion 16. That is, prior to brazing, the intermediate combination portion 16 is preliminarily combined by using a rivet 70 and then the header and the tank are brazed. Since the intermediate combination portion 16 is pressed by a predetermined force generated by an elastic force of the rivet 70, a stable preliminary combination can be made. The combination of the header and the tank by brazing is smoothly performed in the subsequent brazing process.

Although the above-described combination reinforcement portions are shown together in the drawings, all of the combination reinforcement portions do not need to be employed at the same time and at least one portion can be used.

Figure 6:
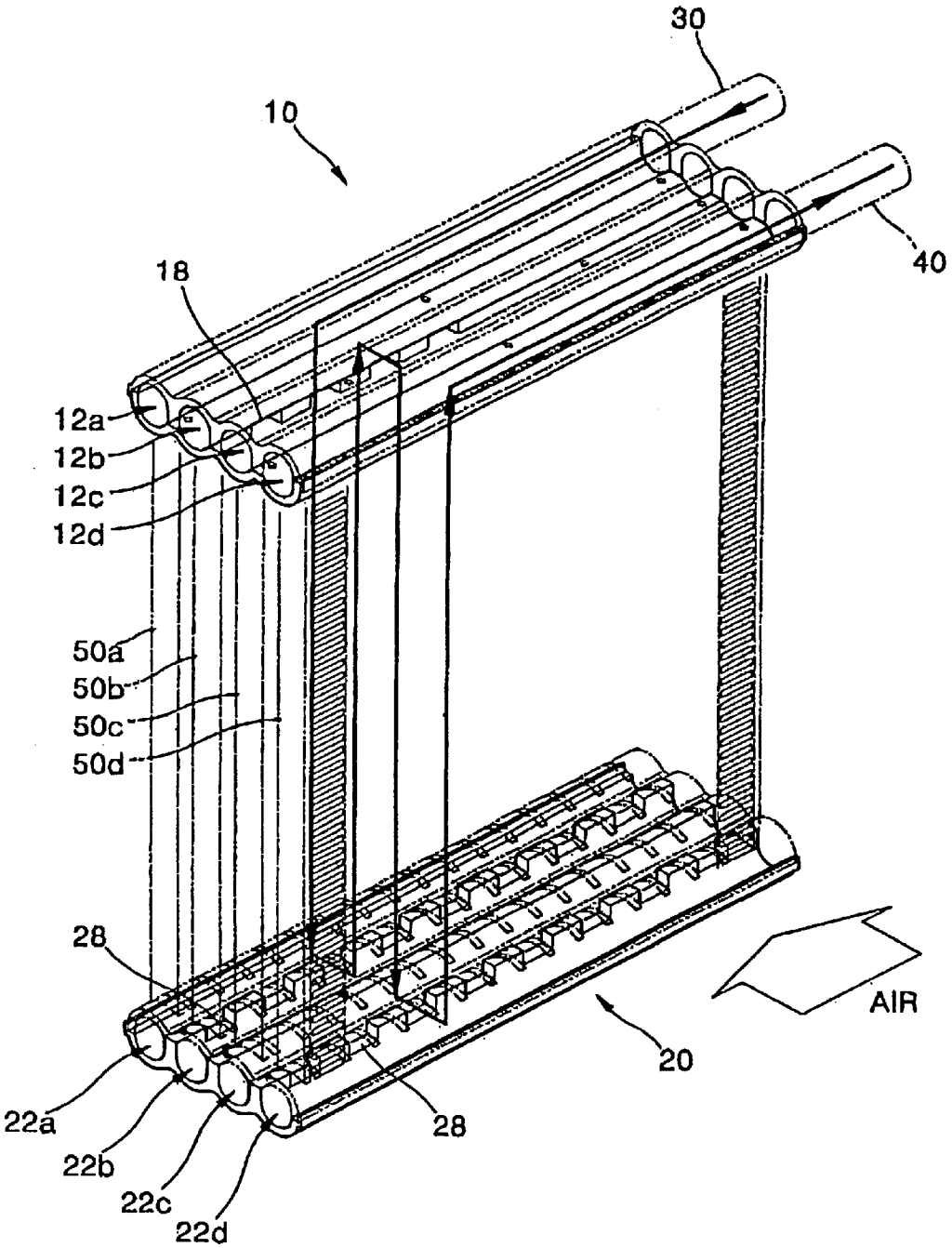

The operation of the present invention having the above structure will now be described. FIGS. 5 and 6 show the flows of a refrigerant in heat exchangers according to preferred embodiments of the present invention in which the return holes are formed differently.

First, in the heat exchanger as shown in FIG. 5, a plurality of return holes 18 are formed between the second partition chamber 12*b* and the third partition chamber 12*c* of the first header pipe 10. In the second header pipe 20, the return holes 28 are formed between the fifth partition chamber 22*a* and the sixth partition chamber 22*b* and between the seventh partition chamber 22*c* and the eighth partition chamber 22*d*. The return holes 18 and 28 can be formed to be about half the length of each partition chamber so that the loss of pressure is reduced and the refrigerant is uniformly distributed in the entire heat exchanger.

In the above heat exchanger, the refrigerant enters in the first partition chamber 12*a* through the refrigerant inlet pipe 30 and flows toward the fifth partition chamber 22*a* of the second header pipe 20 while heat exchange is performed through the first tube group 50*a*. Then, the refrigerant is returned to the sixth partition chamber 22*b* through the return holes 28 and flows toward the second partition chamber 12*b* while heat exchange is performed through the second tube group 50*b*. The refrigerant in the second partition camber 12*b* is returned to the third partition chamber 12*c* through the return holes 18. The refrigerant in the third partition chamber 12*c* flows in the seventh partition chamber 22*c* through the third tube group 50*c*. Then, the refrigerant in the seventh partition chamber 22*c* is returned to the eighth partition chamber 22*d* through the return holes 28, flows through the fourth tube group 50*d* and the fourth partition chamber 12*d*, and finally is exhausted outside through the refrigerant outlet pipe 40.

In a heat exchanger shown in FIG. 6, the return holes 28 formed on the second header pipe 20 are formed along the entire length of the partition chamber so that the loss of pressure of the refrigerant in the second header pipe 20 can be reduced. Since the operation of the heat exchanger in relation to the flow of the refrigerant is the same as that of the preferred embodiment shown in FIG. 5, a detailed description thereof will be omitted.

In the meantime, in the above heat exchanger, air performing heat exchange with the refrigerant flows from a direction where the refrigerant outlet pipe 40 is formed so that an efficiency in heat exchange can be improved. That is, by making the overall flow of the refrigerant entering through the refrigerant inlet pipe 30 and being exhausted through the refrigerant outlet pipe 40 adverse to a direction of the flow of air, the difference in temperature between the refrigerant and the air is made constant so that the efficiency in heat exchange is increased.

The flow of the refrigerant of the heat exchanger can be diversely modified according to the position and range of the return holes.

As described above, since the heat exchanger according to the present invention has a simple structure and can secure a pressure-resistance feature, the heat exchanger is appropriate to be used as a heat exchanger for a $CO_2$ refrigerant using $CO_2$ as a refrigerant. Also, since a brazing feature of the header and the tank of the heat exchanger can be improved, leakage of a refrigerant is prevented and durability can be improved.

The structure of the header and the tank of the heat exchanger is simplified and the thickness of the heat exchanger can be minimized so that a structure which is small and light can be provided.

In addition, the flow of a refrigerant can be guide in various ways, a multilayer heat exchanger having a superior refrigerant flow feature can be provided, an assembly feature can be improved by simplifying the structure of the heat exchanger and reducing the number of steps, and the number of parts can be reduced due to a simplified structure so that a manufacturing cost and a raw cost can be reduced and productivity can be improved.

Furthermore, when the heat exchange is used as an evaporator, since three or more rows of tube groups are present, condensate water generated on a surface of the evaporator is more easily drained so that performance is improved and generation of odor is removed. That is, when there are three rows of tube groups, since the width of the tube is narrow, condensate water generated between the tube groups flows through a gap between the tube groups so that the condensate water can be easily drained.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A heat exchanger for a $CO_2$ refrigerant comprising:

at least three rows of tube groups arrayed in an airflow direction including a plurality of tubes having an independent refrigerant path;

first and second header pipes including a header where a plurality of tube insertion holes into which the tubes are inserted are formed and a tank having partition walls formed along a direction of the flow of a refrigerant, said direction of the flow of a refrigerant being perpendicular to said airflow direction wherein a plurality of return holes are formed in the partition walls;

end caps sealing both end portions of the first and second header pipes;

a coupling reinforcement portion installed at least one of the first and second header pipes and reinforcing a coupling force of the header and the tank;

a refrigerant inlet pipe connected to the first or second header pipe through which the refrigerant enters; and a refrigerant outlet pipe connected to the first or second header pipe through which the refrigerant is exhausted, wherein the refrigerant entering through the refrigerant inlet pipe is made to flow in a direction adverse to a direction in which air flows.

2. The heat exchanger as claimed in claim 1, wherein the refrigerant inlet and outlet pipes are installed at a side end portion of the first or second header pipe.

3. The heat exchanger as claimed in claim 1, wherein the coupling reinforcement portion is a pressing protrusion extending from an edge of each of the end caps over an outer surface of the header and the tank.

4. The heat exchanger as claimed in claim 1, wherein the coupling reinforcement portion is a band member provided to encompass an outer surface of the header and the tank.

5. The heat exchanger as claimed in claim 1, wherein the coupling reinforcement portion is a rivet coupling the header and the tank by penetrating the partition walls.

6. The heat exchanger as claimed in claim 1, wherein, assuming that a width of the return hole is W1 and a distance between the neighboring return holes is W2, W1 and W2 satisfy a relationship that $W1/(W1+W2) \leqq 0.5$.

* * * * *